US006627583B2

(12) United States Patent
Inoue et al.

(10) Patent No.: US 6,627,583 B2
(45) Date of Patent: Sep. 30, 2003

(54) ENGINE OIL COMPOSITION

(75) Inventors: Kiyoshi Inoue, Hiratsuka (JP); Jinichi Igarashi, Tokyo (JP); Mituaki Ishimaru, Yokohama (JP); Mineo Kagaya, Fujisawa (JP); Masakuni Hirata, Tokyo (JP)

(73) Assignee: Nippon Mitsubishi Oil Corporation (JP)

( * ) Notice: Subject to any disclaimer, the term of this patent is extended or adjusted under 35 U.S.C. 154(b) by 0 days.

(21) Appl. No.: 09/771,924

(22) Filed: Jan. 30, 2001

(65) Prior Publication Data

US 2001/0044387 A1 Nov. 22, 2001

Related U.S. Application Data

(63) Continuation-in-part of application No. 08/453,460, filed on May 30, 1995, now abandoned, which is a continuation-in-part of application No. 08/124,671, filed on Sep. 22, 1993, now abandoned, which is a continuation of application No. 07/895,469, filed on Jun. 8, 1992, now abandoned, which is a continuation of application No. 07/669,872, filed on Mar. 14, 1991, now abandoned.

(30) Foreign Application Priority Data

Mar. 16, 1990 (JP) ..... 2-66315

(51) Int. Cl.[7] ..... C10M 159/20

(52) U.S. Cl. ..... 508/186; 508/363; 508/364; 508/365

(58) Field of Search ..... 508/186, 363, 508/364, 365

(56) References Cited

U.S. PATENT DOCUMENTS

| | | | | |
|---|---|---|---|---|
| 3,509,051 | A | * | 4/1970 | Farmer et al. |
| 3,925,213 | A | * | 12/1975 | Froeschmann |
| 4,098,705 | A | * | 7/1978 | Sakurai et al. |
| 4,529,526 | A | * | 7/1985 | Inoue et al. |
| 4,539,126 | A | * | 9/1985 | Bleeker et al. |
| 4,681,694 | A | * | 7/1987 | Zoleski et al. |
| 4,683,126 | A | * | 7/1987 | Inoue et al. |
| 4,938,882 | A | * | 7/1990 | Tipton |
| 4,965,003 | A | * | 10/1990 | Schlicht |
| 4,965,004 | A | * | 10/1990 | Schlicht |
| 5,152,908 | A | * | 10/1992 | Tipton |
| 5,380,508 | A | * | 1/1995 | Inoue |

OTHER PUBLICATIONS

Kiyoshi Inoue, "Calcium Borate Overbased Metallic Detergent," Journal of the Society of Tribologists and Lubrication Engineers, Apr., 1993, pp. 263–268.

* cited by examiner

*Primary Examiner*—Margaret Medley
(74) *Attorney, Agent, or Firm*—Ostrolenk, Faber, Gerb & Soffen, LLP

(57) ABSTRACT

An engine oil composition characterized by containing a major amount of lubricating base oil and (a) 0.01 to 30% by weight of an overbasic oil-soluble metal salt prepared by use of an alkaline-earth metal borate, (b) 0.01 to 5% by weight of a molybdenum dithiocarbamate, and (c) 0.01 to 5% by weight of an antioxidant as essential components, on the basis of the total amount of the composition.

4 Claims, No Drawings

ENGINE OIL COMPOSITION

This is a continuation-in-part of application Ser. No. 08/453,460 filed on May 30, 1995, now abandoned, which is a continuation-in-part of application Ser. No. 08/124,671 filed on Sep. 22, 1993, now abandoned, which is a continuation of application Ser. No. 07/895,469 filed on Jun. 8, 1992, now abandoned, which is a continuation of application Ser. No. 07/669,872 filed on Mar. 14, 1991, now abandoned.

BACKGROUND OF THE INVENTION

1. Field of the Invention

The invention relates to an engine oil composition, and more particularly to an engine oil composition useful as a lubricating oil for gasoline engines, diesel engines, and the like.

2. Description of the Related Art

Because of increased concern regarding the energy-saving measures to counter oil shocks, the research for a fuel-saving internal combustion engine lubricating oil has been recently intensified. As measures for fuel-saving by use of lubricating oil to meet such a situation, the following measures are now under review among business circles: (a) lowering viscosity of lubricating oil with the intention of reducing engine friction loss under hydrodynamic lubricating conditions, and (b) addition of friction reducers with the intention of reducing engine friction loss under mixed and boundary lubrication.

Addition of friction modifiers to lubricating oil is indispensable especially in the latest fuel-saving lubricating oil, and many compounds have heretofore been found to be useful. However, it has been observed that even though these compound possess a high fuel-saving effect on the fresh lubricating oil, they gradually lose said effect in the aged lubricating oil due to degradation during engine operation. While many antioxidants have widely been used heretofore and proved to be effective to some extent for preventing the degradation, they could not necessarily provide satisfactory results in view of their lubricating performance.

For example, an engine oil composition comprising over-based borated metal salts are known from U.S. Pat. No. 4,539,126 corresponding to Japanese Patent Laid-open Publication No. 60-116688. This publication discloses that an antiwear such as zinc dithiophosphates or an antioxidant such as amine type or phenol type antioxidant may be added into this composition. However, even if an antioxidant and/or zinc dithiophosphate, which are given as an optional additive in this patent, are combined and employed, the friction coefficient of the engine oil is insufficiently high for the purpose. In general, an antiwear is an additive having a function of preventing wear of sliding surfaces. On the contrary, a friction modifier is an additive having a function of decreasing a friction coefficient of sliding surfaces, and thus its function is quite different from that of an antiwear.

Furthermore, over-based borated metal salts are known from U.S. Pat. No. 4,683,126 corresponding to Japanese Patent Laid-open Publication No. 61-204298, however, the friction coefficient of the engine oil when employing only such an additive is insufficiently high.

In addition, engine oil compositions comprising sulfur-phosphorus type additive and molybdenum dithiophosphates are known from U.S. Pat. No. 3,925,213, however, the friction coefficient of the engine oil employing such an additive is insufficiently high after oxidative degradation, and thus fuel-saving effect may be very low.

The present invention is based on a discovery that excellent fuel-saving effect can be attained employing an overbasic metallic detergent prepared by use of an alkaline earth metal borate as an additional component of an engine oil composition containing at least one molybdenum dithiocarbamate and an antioxidant.

The present invention provides an engine oil composition having a specific combination of lubricating additives and excellent fuel-saving effect over a long period of time.

SUMMARY OF THE INVENTION

It is an object of the present invention to provide a fuel-saving engine oil composition comprising a major amount of lubricating base oil and as essential components, on the basis of the total weight of that composition, (a) 0.01 to 30% by weight of an overbasic oil-soluble metal salt which is the reaction product of an oil-soluble metal salt with an alkaline earth metal oxide or hydroxide in the presence of boric acid or boric acid anhydride, (b) 0.01 to 5% by weight of a molybdenum dithiocarbamate, and (c) 0.01 to 5% by weight of an antioxidant selected from the group consisting of phenolic, amino, sulfur, zinc thiophosphate and phenothiazine type antioxidants.

DETAILED DESCRIPTION OF THE PREFERRED EMBODIMENTS

Either mineral oils or synthetic oils may be used as the lubricating base oils of the present invention. Any paraffinic or naphthenic lubricating base oils may be acceptable wherein said base oils are manufactured by a process consisting mainly of topping crude oil followed by vacuum distillation to give a lubricating oil fraction, and refining said lubricating fraction by at least one process selected from the group consisting of solvent deasphalting, solvent extraction, hydro-cracking, solvent dewaxing, catalytic dewaxing, hydro-refining, sulfuric acid treating, and clay treating.

The synthetic oils of the present invention include, α-olefin polymers (polybutenes, octene1 oligomers, decene-1 oligomers and the like) or hydrogenated derivatives thereof, alkylbenzenes, alkylnaphthalenes, diesters (ditridecyl glutarate, di-2-ethylhexyl adipate, diisodecy adipate, ditridecyl adipate, di-3-ethylhexyl sebacate, and the like), polyol esters (trimethylolpropane caprylate, trimethylolpropane pelargonate, pentaerythritol-2-ethylhexanoate, pentaerythritol pelargonate, and the like), polyoxyalkylene glycol, polyphenyl ether, silicon oils, perfluoroalkyl esters, and mixtures thereof.

Preferred kinematic viscosity of these lubricating base oils is in a range of 3 to 20 cSt at 100° C.

The overbasic oil-soluble metal salts (a) of the present invention are prepared by a reaction of an oil-soluble metal salt such as an oil-soluble alkaline-earth metal sulfonate, oil-soluble alkaline-earth metal salicylate, oil-soluble alkaline-earth metal phenate, oil-soluble alkaline-earth metal phenate, oil-soluble alkaline-earth metal phosphate with an oxide or hydroxide of an alkaline-metal in the presence of boric acid or boric acid anhydride. Among alkaline-earth metal, magnesium, calcium and barium are appropriately used, and calcium is most appropriate. Among oil-soluble metal salts, oil-soluble alkaline-earth metal salicylates are most appropriate. The overbasic oil-soluble metal salt is a dispersion where a produced alkaline-earth metal borate is dispersed by assist of oil-soluble metal salt.

Generally, the overbasic oil-soluble metal salts (a) of the present invention have a total base number (so-called "TBN") of a lower limit of 100, and preferably 170, and of an upper limit of 400, and preferably 300. A particle size of the alkaline-earth metal borate in the overbasic oil-soluble metal salt is less than 0.1 μm, and preferably less than 0.05 μm.

Any methods for preparing the overbasic metal salts may be acceptable. For example, a method has been known which comprises reacting an oil-soluble metal salt aforesaid, a hydroxide or an oxide of alkaline-earth metal, and boric acid or boric acid anhydride in the presence of water, an alcohol such as methanol, ethanol, propanol, or butanol, and a diluent such as benzene, toluene or xylene at a temperature of 20 to 200° C. for 2 to 8 hours, heating the mixture at 100 to 200° C. to remove water, followed by removing the alcohol and the diluent if necessary, to give an overbasic metal salt. The reaction conditions may be employed suitably depending on raw material type, the amount of reactants and the like. Typical of such prior art practices are those disclosed in Japanese Patent Publication No. 61-204298 corresponding to U.S. Pat. No. 4,683,126 and the disclosures of which are incorporated herein by reference.

The content of the overbasic metal salt prepared by use of an alkaline-earth metal borate of the present invention is in an amount of a lower limit of 0.01, and preferably 0.05% by weight and of an upper limit of 30% by weight, and preferable 5% by weight, on the basis of the total amount of the composition.

The content of less than the lower limit is not preferable because of the insufficient display of the fuel-saving effect of the overbasic metal salt wherein the effect can not be maintained over a long period of time. Inversely, when it is in excess of the upper limit, there is no additional merit due to the excessive addition. Other overbasic oil-soluble metal salts, such as those prepared by use of alkaline earth metal carbonates can not provide an engine oil composition which can persistently maintain the fuel-saving effect throughout the engine operation.

Any molybdenum dithiocarbamates (b) which have been used in conventional engine oils may be employed in the present invention.

Typical molybdenum dithiocarbamates include molybdenum sulfide diethyldithiocarbamate, molybdenum sulfide dipropyldithiocarbamate, molybdenum sulfide dibutyldithiocarbamate, molybdenum sulfide dipentyldithiocarbamate, molybdenum sulfide, dihexyldithiocarbamate, molybdenum sulfide dioctyldithiocarbamate, molybdenum sulfide didecyldithiocarbamate, molybdenum sulfide didodecyldithiocarbamate, molybdenum sulfide ditridecyldithiocarbamate, molybdenum sulfide di(butylphenyl)dithiocarbamate, molybdenum sulfide di(nonylphenyl)dithiocarbamate, oxymolybdenum sulfide diethyldithiocarbamate, oxymolybdenum sulfide dibutyldithiocarbamate, oxymolybdenum sulfide dipentyldithiocarbamate, oxymolybdenum sulfide dihexyldithiocarbamate, oxymolybdenum sulfide dioctyldithiocarbamate, oxymolybdenum sulfide didecyldithiocarbamate, oxymolybdenum sulfide didodecyldithiocarbamate, oxymolybdenum sulfide ditridecyldithiocarbamate, oxymolybdenum sulfide di(butylphenyl) dithiocarbamate, oxymolybdenum sulfide di(nonylphenyl) dithiocarbamate, and mixtures thereof. Among them, molybdenum sulfide dibutyldithiocarbamate, molybdenum sulfide dipentyldithiocarbamate, molybdenum sulfide dihexyldithiocarbamate, molybdenum sulfide dioctyldithiocarbamate, molybdenum sulfide didecyldithiocarbamate, molybdenum sulfide didodecyldithiocarbamate, and molybdenum sulfide ditridecyldithiocarbamate are most preferable.

According to the present invention, the molybdenum dithiocarbamate (b) is one selected from the group listed above, and a mixture thereof may be employed. In case of selecting the compound from the group listed above, the compound has only one kind of alkyl group or alkyphenyl group in its structure. However, if a plurality of starting materials comprising different alkyl group or alkylphenyl group are used when preparing, the resulted compound has a plurality of alkyl or alkylphenyl group having different kinds in its structure and such a compound or a mixture thereof can be used in the present invention.

The content of the molybdenum dithiocarbamate (b) of the present invention is in an amount of a lower limit of 0.01% by weight, and preferably 0.05% by weight, and of an upper limit of 5% by weight, and preferably 2% by weight, on the basis of the total amount of the composition.

The content of less than the lower limit is not preferable because of the insufficient display of the friction reducing effect. Inversely, when it is in excess of the upper limit, there is no additional merit due to the excessive addition.

Any antioxidants (c) may be employed which have been used in conventional engine oils. Such antioxidants, for example, include phenol type, amine type, sulfur type, zinc thiophosphate type, phenothiazine type antioxidants, and the mixture thereof. Typically, they include diphenylamine, p,p'-dioctyl diphenylamine, p,p'-dinonyl diphenylamine, p,p'-didodecyl diphenylamine, phenyl-α-naphthylamine, p-octylphenyl-oc-naphthylamine, p-nonylphenyl-α-naphthylamine, p-dodecylphenyl-α-naphthylamine, 2,6-ditert.-butylphenol, 2,6-ditert.-butyl-p-cresol, 2,6-ditert.-butyl-4-ethylphenol, 2,2'-methylenebis(4methyl-6tert.-butylphenol), 2,2'-methylenebis (4-ethyl-6-tert.-butylphenol), 4,4'-methylenebis(2,6-di-tert.-butylphenol), 4,4-bis(2,6-di-tert.-butylphenol), 4,4'-thiobis(6tert.-butyl-o-cresol), zinc dialkyl dithiophosphate, phenothiazine, and mixtures thereof.

The content of the antioxidant (c) of the present invention is an amount of a lower limit of 0.01% by weight, and of an upper limit of 5% by weight, and preferably 2% by weight, on the basis of the total amount of the composition.

A content of less than the lower limit is not preferable because of the display of the antioxidation effect for a short period of time. Inversely, when it is in excess of the upper limit, there is no additional merit due to the excessive addition.

In the present invention, the following conventional lubricating oil additives can be additionally used to improve further the performance of the present composition if necessary, in so far as they do not deviate from the gist of the present invention. Examples of these additives include extreme pressure additives such as tricresyl phosphate, triphenyl phosphate, zinc dithiophosphate; rust preventives such as petroleum sulfonates, dinoyl naphthalene sulfonates and the like; metal deactivating agents such as benzotriazole and the like; metal-based detergents such as alkaline-earth metal sulfonates, alkaline-earth metal salicylates, alkaline-earth metal phenates, alkaline-earth metal phosphonates and the like; ashless dispersants such as succinimide, succinic esters, benzylamine and the like; deformants such as silicon oils and the like; viscosity index improvers and pour point depressants such as polymethacrylates, polyisobutylenes and polystyrenes and the like; and mixtures thereof.

Generally, the content of the viscosity improver is an amount of 1 to 30% by weight, the deformant is in an amount of 0.0005 to 1% by weight, the metal deactivating agent is in an amount of 0.005 to 1% by weight, and other additives are in amounts of 0.1 to 15% by weight respectively on the basis of the total amount of the composition.

The engine oil compositions of the present invention are suitable for two cycle and four cycle gasoline engine oils, diesel engine oil for land use, marine diesel engine oil, and the like.

While the advantages of the compositions according to the present invention will be described in detail hereinbelow in conjunction with the following examples, it is to be noted that the scope of the present invention should not be limited to these examples.

EXAMPLES AND COMPARATIVE EXAMPLES

As indicated in Table 1, five engine oil compositions, Example A and Comparative Examples 1–4, were prepared. Performance tests were conducts with respect to these compositions by the following methods.

LFW Friction Test

LFW friction test is carried out on both oxidation degraded samples and freshly prepared samples. The test conditions are as follows:

Load: 30 lb

Speed: 1500 r.p.m.

Oil Temperature: 80° C.

The oxidation degraded sample oils were prepared by oxidizing new sample oils under the following conditions on the basis of "the method for testing oxidation stability of lubricating oil" prescribed by JIS K 2514 3.1:

Temperature: 150° C.

Duration: 72 hours

Table 1 shows the test results.

As is apparent from the results shown in Table 1, the engine oil composition according to the present invention has excellent performance as an engine oil in which the fuel-saving effect can be maintained persistently throughout the engine operation because of the synergism of each component.

On the contrary, when the compositions of Comparative Examples 1 and 2 in which an overbasic oil-soluble metal salt prepared by use of calcium carbonate is used instead of an overbasic oil-soluble metal salt (a) prepared by use of an alkaline-earth metal borate is employed, or an antioxidant of component (c) of the present invention is omitted, are compared with those of Example A respectively, the friction coefficient increases after oxidation degradation in both cases, and the time during which the fuel-saving effect may be maintained is shorter in both cases.

Further, when the composition of Comparative Example 3 in which zinc dithiophosphate known as an antiwear is used instead of molybdenum dithiocarbamate (b) is employed, the friction coefficient thereof is high even before oxidation degradation, and it changes after oxidation degradation. Therefore, it is obvious that the fuel-saving effect may not be maintained and expected. Namely, it can be recognized that zinc dithiophosphate does not have a function as a friction modifier.

In addition, when the composition of Comparative Example 4 in which molybdenum dithiophosphate known as a friction modifier is used instead of molybdenum dithiocarbamate (b) is employed, the friction coefficient increases after oxidation degradation. Namely, any fuel-saving effect can not be maintained. As discussed above, according to the present invention, the inventors have found that excellent fuel-saving effect can be obtained by selecting molybdenum dithiocarbamate as a friction modifier and it can not be expected by the result when employing molybdenum dithiophosphate as a friction modifier.

TABLE 1

| | | Example A | Comparative Example 1 | Comparative Example 2 | Comparative Example 3 | Comparative Example 4 |
|---|---|---|---|---|---|---|
| Component (a) or the like | Calcium borate[1)] | 2.1 | — | 2.1 | 2.1 | 2.1 |
| | Calcium carbonate[2)] | — | 2.1 | — | — | — |
| Component (b) or the like | Molybdenum dithiocarbamate[3)] | 1.1 | 1.1 | 1.1 | — | — |
| | Zinc dithiophosphate[4)] | — | — | — | 0.7 | — |
| | Molybdenum dithiophosphate[5)] | — | — | — | — | 0.55 |
| Component (c) or the like | Amine type antioxidant | 0.15 | 0.15 | — | 0.15 | 0.15 |
| | Phenol type antioxidant | 0.3 | 0.13 | — | 0.3 | 0.3 |
| Other Additives | Viscosity index improver, Ashless dispersant and the like | 10.8 | 10.8 | 10.8 | 10.8 | 10.8 |
| | Refined mineral oil (3.7 cSt @ 100° C.) | the balance | the balance | the balance | the balance | the balance |
| Lubricating Performance | Friction coefficient | | | | | |
| | before degradation | 0.040 | 0.045 | 0.040 | 0.092 | 0.040 |
| | after degradation | 0.040 | 0.065 | 0.060 | 0.081 | 0.080 |

[1)]Overbasic oil-soluble metal salt prepared by use of oil-soluble calcium salicylate, calcium hydroxide and boric acid (TBN of 195, particle size of calcium borate of 0.01 μm).

[2)]Overbasic oil-soluble metal salt prepared by use of oil-soluble calcium salicylate, calcium hydroxide and carbon dioxide (TBN of 195, particle size of calcium carbonate of 0.01 μm).

[3)]Mixture of molybdenum sulfide dioctyldithiocarbamate and molybdenum sulfide ditridecyldithiocarbamate in a weight ratio of 1:1 (diluted by a diluent, effective concentration of 20 wt %, molybdenum content of 4.5 wt %, molybdenum content in engine oil composition of 0.05 wt %).

[4)]Zinc di(2-methylpentyl) dithiophosphate (diluted by a diluent, effective concentration of 71.7 wt %, zinc content of 7.1 wt %, zinc content in oil of 0.05 wt %).

[5)]Molybdenum sulfide dioctyldithiophosphate (diluted by a diluent, effective concentration of 50 wt %, molybdenum content of 9.0 wt %, molybdenum content in engine oil composition of 0.05 wt %).

Further, as described in the footnote of Table 1, in these experiments molybdenum dithiocarbamate, zinc dithiophosphate and molybdenum dithiophosphate are employed as commercially available ones which are diluted by a diluent. Accordingly, in order to compare the effect of the compound, they are used so as to equalize the metal concentrations.

Additional Examples are discussed below as detailed in Table 2.

Example B

A composition similar to Example A, except that 10 mass % of borated salicylate is mixed. Consequently, friction is inferior to the one in Example A, while friction after deterioration is retained.

Example C

A composition similar to Example A, except that the concentration of MoDTC is controlled to be 3.0 mass %. An increase of MoDTC decreases friction, and friction is retained even after deterioration.

Example D

Composition is similar to Example A, except that the total concentration of an ingredient (c) is decreased to be 0.15 mass %. Consequently, friction is decreased, and friction after deterioration is somewhat deteriorated, but somewhat retained.

Example E

A composition similar to Example A, except that the total concentration of an ingredient (c) is increased to be 2.5 mass %. Consequently, friction is decreased, and friction after deterioration is somewhat deteriorated, but somewhat retained.

Example F

A composition similar to Example A, except that borated calcium sulfonate which is an ingredient (a) of the present invention is used. Consequently, friction is about the same as the one in Example A.

Added Example G

A composition similar to Example A, except that borated calcium phenate which is an ingredient (a) of the present invention is used. Consequently, friction is somewhat inferior to the one in Example A, although the performance is about the same as the one in Example A.

TABLE 2

| | | Example B | Example C | Example D | Example E | Example F | Example G |
|---|---|---|---|---|---|---|---|
| Component (a) or the like | Calcium borate[1)] | 10.0 | 2.1 | 2.1 | 2.1 | — | — |
| | Calcium carbonate[2)] | — | — | — | — | — | — |
| | Calcium borate[6)] | — | — | — | — | 2.1 | — |
| | Calcium borate[7)] | — | — | — | — | — | 2.1 |
| | Calcium borate[8)] | | | | | | — |
| | Calcium carbonate[9)] | — | — | — | — | — | — |
| Component (b) or the like | Molybdenum dithiocarbamate[3)] | 1.1 | 3.0 | 1.1 | 1.1 | 1.1 | 1.1 |
| | Zinc dithiophosphate[4)] | — | — | — | — | — | — |
| | Molybdenum dithiophosphate[5)] | — | — | — | — | — | — |
| Component (c) or the like | Amine type antioxidant | 0.15 | 0.15 | 0.05 | 1.50 | 0.15 | 0.15 |
| | Phenol type antioxidant | 0.3 | 0.3 | 0.1 | 2.0 | 0.3 | 0.3 |
| Other Additives | Viscosity index improver, Ashless dispersant and the like | 10.8 | 10.8 | 10.8 | 10.8 | 10.8 | 10.8 |
| | Refined mineral oil (3.7 cSt@100) | the balance | the balance | the balance | the balance | the balance | the balance |
| Lubricating | Friction coefficient | | | | | | |
| Performance | before degradation | 0.045 | 0.035 | 0.040 | 0.040 | 0.038 | 0.043 |
| | after degradation | 0.045 | 0.035 | 0.045 | 0.043 | 0.041 | 0.045 |

[1)]Overbasic oil-soluble metal salt prepared by use of oil-soluble calcium salicylate, calcium hydroxide and boric acid (TBN of 195, particle size of calcium borate of 0.01 μm)
[2)]Overbasic oil-soluble metal salt prepared by use of oil-soluble calcium salicylate, calcium hydroxide and carbon dioxide (TBN of 195, particle size of calcium carbonate of 0.01 μm)
[3)]Mixture of molybdenum sulfide dioctyldithiocarbamate and molybdenum sulfide ditridecyldithiocarbamate in a weight ratio of 1:1 (diluted by a diluent, effective concentration of 20 wt %, molybdenum content of 4.5 wt %, molybdenum content in engine oil composition of 0.05 wt %)
[4)]Zinc di(2-methylpentyl)dithiophosphate (diluted by a diluent, effective concentration of 71.7 wt %, zinc content of 7.1 wt %, zinc content in oil of 0.05 wt %)
[5)]Molybdenum sulfide dioctyldithiophosphate (diluted by a diluent, effective concentration of 50 wt %, molybdenum content of 9.0 wt %, molybdenum content in engine oil composition of 0.05 wt %)
[6)]Overbasic oil-soluble metal salt prepared by use of oil-soluble calcium sulfonate, calcium hydroxide and boric acid (TBN of 300, particle size of calcium borate of 0.01 μm)
[7)]Overbasic oil-soluble metal salt prepared by use of oil-soluble calcium phenate, calcium hydroxide and boric acid (TBN of 250, particle size of calcium borate of 0.01 μm)
[8)]Overbasic oil-soluble metal salt prepared by use of oil-soluble calcium salicylate, calcium hydroxide and carbon dioxide, and then reacted with boric acid (TBN of 170)
[9)]Overbasic oil-soluble metal salt prep'd by use of oil-soluble calcium surfonate, calcium hydroxide and carbon dioxide (TBN = 300)

Additional Comparative Examples are discussed below and are detailed in Table 3:

Comparative Example 5

A composition is similar to Example A, except that the total concentration of the ingredient (c) is controlled to be 0.08 mass % which is of less than the lower limit. Consequently, the friction reducing effect after deterioration is poor.

Comparative Example 6

A composition is produced by increasing MoDTP in Comparative Example 4 to 1.1 mass % which is the same as that of MoDTC. Consequently, the friction reducing effect after deterioration is similarly poor.

Comparative Example 7

A composition is similar to Example A, except that none of the ingredient (a) is incorporated. Consequently, the friction reducing effect after deterioration is poor.

Comparative Example 8

A composition is similar to Example A, except that the ingredient (a) is used in an amount of 0.005 mass % which is of less than the lower limit. Consequently, the friction reducing effect after deterioration is poor.

Comparative Example 9

A composition is similar to Example A, except that MoDTC is used in an amount of 0.005 mass % which is of less than the lower limit. Consequently, friction is high, and friction after deterioration is higher.

Comparative Example 10

A composition is similar to Example A, except that MoDTC is used in an amount of 6 mass % which is more than the upper limit. Consequently, friction is low, but the friction reducing effect after deterioration is poor.

Comparative Example 11

A composition is similar to Example A, except that the total concentration of the ingredient (c) is controlled to be 6 mass % which is of more than the upper limit. Consequently, the friction reducing effect after deterioration is poor.

Comparative Example 12

A composition is similar to Example A, except that a material as produced by subjecting a Ca-salicylate as disclosed by Bleeker et al. to calcium carbonate so as to transform the same into an overbasic one, and reacting the same with boric acid is used. Consequently, friction after deterioration is somewhat inferior to the one in Example A.

Comparative Example 13

A composition is produced according to a recipe as disclosed by Inoue et al.; namely, by mixing overbasic calcium carbonate sulfonate, MoDTC and ZDTP, wherein other additives are the same as the ones in other Examples of the application concerned. Consequently, the friction reducing effect after deterioration is poor.

TABLE 3

| | | Comparative Example 5 | Comparative Example 6 | Comparative Example 7 | Comparative Example 8 | Comparative Example 9 | Comparative Example 10 | Comparative Example 11 | Comparative Example 12 | Comparative Example 13 |
|---|---|---|---|---|---|---|---|---|---|---|
| Component (a) or the like | Calcium borate[1)] | 2.1 | 2.1 | — | 0.005 | 2.1 | 2.1 | 2.1 | — | — |
| | Calcium carbonate[2)] | — | — | — | — | — | — | — | — | — |
| | Calcium borate[6)] | — | — | — | — | — | — | — | — | — |
| | Calcium borate[7)] | — | — | — | — | — | — | — | — | — |
| | Calcium borate[8)] | — | — | — | — | — | — | — | 2.1 | — |
| | Calcium carbonate[9)] | — | — | — | — | — | — | — | — | 2.1 |
| Component (b) or the like | Molybdenum dithiocarbamate[3)] | 1.1 | — | 1.1 | 1.1 | 0.005 | 6 | 1.1 | 1.1 | 1.1 |
| | Zinc dithiophosphate[4)] | — | — | — | — | — | — | — | — | 0.7 |
| | Molybdenum dithiophosphate[5)] | — | 1.1 | — | — | — | — | — | — | — |
| Component (c) or the like | Amine type antioxidant | 0.03 | 0.15 | 0.15 | 0.15 | 0.15 | 0.15 | 3 | 0.15 | — |
| | Phenol type antioxidant | 0.005 | 0.3 | 0.3 | 0.3 | 0.3 | 0.3 | 3 | 0.3 | — |
| Other Additives | Viscosity index improver, Ashless dispersant and the like | 10.8 | 10.8 | 10.8 | 10.8 | 10.8 | 10.8 | 10.8 | 10.8 | 10.8 |
| | Refined mineral oil (3.7 cSt @ 100) | the balance | the balance | the balance | the balance | the balance | the balance | the balance | the balance | the balance |
| Lubricating Performance | Friction coefficient | | | | | | | | | |
| | before degradation | 0.04 | 0.038 | 0.045 | 0.042 | 0.08 | 0.035 | 0.04 | 0.04 | 0.045 |
| | after degradation | 0.058 | 0.074 | 0.085 | 0.088 | 0.09 | 0.085 | 0.062 | 0.045 | 0.065 |

[1)]Overbasic oil-soluble metal salt prepared by use of oil-soluble calcium salicylate, calcium hydroxide and boric acid (TBN of 195, particle size of calcium borate of 0.01 μm).

[2)]Overbasic oil-soluble metal salt prepared by use of oil-soluble calcium salicylate, calcium hydroxide and carbon dioxide (TBN of 195, particle size of calcium carbonate of 0.01 μm).

[3)]Mixture of molybdenum sulfide dioctyldithiocarbamate and molybdenum sulfide ditridecyldithiocarbamate in a weight ratio of 1:1 (diluted by a diluent, effective concentration of 20 wt %, molybdenum content of 4.5 wt %, molybdenum content in engine oil composition of 0.05 wt %).

[4)]Zinc di(2-methylpentyl) dithiophosphate (diluted by a diluent, effective concentration of 71.7 wt %, zinc content of 7.1 wt %, zinc content in oil of 0.05 wt %).

[5)]Molybdenum sulfide dioctyldithiophosphate (diluted by a diluent, effective concentration of 50 wt %, molybdenum content of 9.0 wt %, molybdenum content in engine oil composition of 0.05 wt %)

[6)]Overbasic oil-soluble metal salt prepared by use of oil-soluble calcium sulfonate, calcium hydroxide and boric acid (TBN of 300, particle size of calcium borate of 0.01 μm)

TABLE 3-continued

| | Comparative Example 5 | Comparative Example 6 | Comparative Example 7 | Comparative Example 8 | Comparative Example 9 | Comparative Example 10 | Comparative Example 11 | Comparative Example 12 | Comparative Example 13 |
|---|---|---|---|---|---|---|---|---|---|

[7]Overbasic oil-soluble metal salt prepared by use of oil-soluble calcium phenate, calcium hydroxide and boric acid (TBN of 250, particle size of calcium borate of 0.01 μm)
[8]Overbasic oil-soluble metal salt prepared by use of oil-soluble calcium salicylate, calcium hydroxide and carbon dioxide, and then reacted with boric acid (TBN of 170)
[9]Overbasic oil-soluble metal salt prepared by use of oil-soluble calcium sulfonate, calcium hydroxide and carbon dioxide (TBN = 300)

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

We claim:

1. An engine oil composition comprising a major amount of lubricating base oil and, as essential components, on the basis of the total weight of the composition, (a) 0.01 to 30% by weight of an overbasic oil-soluble metal salt produced by the process consisting essentially of the reaction of an oil-soluble metal salt with an alkaline earth metal oxide or hydroxide in the presence of boric acid or boric acid anhydride, said oil-soluble metal salt being selected from the group consisting of alkaline-earth metal salicylates, alkaline-earth metal phenates, and alkaline-earth-metal phosphonates;

(b) 0.01 to 5% by weight of a molybdenum dithiocarbamate, and (c) 0.01 to 5% by weight of an antioxidant selected from the group consisting of phenolic, amine, sulfur, zinc thiophosphate and phenothiazine antioxidants.

2. The engine oil composition of claim 1 in which the alkaline earth metal is calcium and the antioxidant is a combination of phenolic and amine antioxidants.

3. The engine oil composition of claim 1 in which the amount of overbasic oil-soluble metal salt is 0.05 to 5% by weight, the amount of molybdenum dithiocarbamate is 0.05 to 2% by weight and the amount of antioxidant is 0.1 to 2% by weight.

4. The engine oil composition of claim 1 in which the overbasic oil-soluble metal salt is the reaction product of an alkaline-earth metal salicylates with an alkaline-earth metal oxide or hydroxide in the presence of boric acid or boric acid anhydride.

* * * * *